US005256007A

United States Patent [19]

Allen

[11] Patent Number: 5,256,007

[45] Date of Patent: Oct. 26, 1993

[54] GROUND SUPPORT SYSTEM

[75] Inventor: Robert L. Allen, Kentwood, Mich.

[73] Assignee: Robert Imhoff, Bloomfield Hills, Mich. ; a part interest

[21] Appl. No.: 718,581

[22] Filed: Jun. 21, 1991

[51] Int. Cl.[5] ..... E02D 3/00

[52] U.S. Cl. ..... 405/258; 405/16; 405/303

[58] Field of Search ..... 405/258, 43, 45, 15–19; 411/368, 369, 370, 480, 482, 542, 915

[56] References Cited

U.S. PATENT DOCUMENTS

| | | | |
|---|---|---|---|
| Re. 32,663 | 5/1988 | Atkinson . | |
| 3,597,928 | 8/1971 | Pilaar . | |
| 3,888,087 | 6/1975 | Bergsland | 52/169.5 X |
| 4,045,964 | 9/1977 | Barclay | 52/169.5 X |
| 4,135,843 | 1/1979 | Umemoto et al. . | |
| 4,388,921 | 6/1983 | Sutter et al. | 411/537 X |
| 4,417,828 | 11/1983 | de Winter . | |
| 4,690,585 | 9/1987 | Holmberg . | |
| 4,854,773 | 8/1989 | Nicoll . | |
| 4,860,513 | 8/1989 | Whitman | 411/537 X |
| 4,896,993 | 1/1990 | Bohnhoff . | |
| 4,943,185 | 7/1990 | McGuckin et al. | 405/45 |
| 4,984,384 | 1/1991 | Kaufmann | 405/258 X |

FOREIGN PATENT DOCUMENTS

| | | | |
|---|---|---|---|
| 0026121 | 2/1983 | Japan | 405/258 |
| 0176317 | 10/1983 | Japan | 405/45 |
| 0185818 | 10/1983 | Japan | 405/258 |
| 0273315 | 11/1987 | Japan | 405/45 |

*Primary Examiner*—Dennis L. Taylor

*Attorney, Agent, or Firm*—Gifford, Groh, Sprinkle, Patmore and Anderson

[57] ABSTRACT

A ground support system for providing a stabilizing surface in conjunction with loose soil is disclosed. The system finds particular utility in agricultural applications, such as where horses, cows or bulls and the like are kept. The support system comprises a number of interlockable planar sheets, each planar sheet including a number of conical projections disposed on its bottom side. The conical projections are hollow and open-ended and, in combination with apertures defined in the planar sheet, permit fluids to pass through the system. Traction on the upper surface of each sheet is optionally provided by either scoring or by adhered reground material such as a plastic. The planar sheets may be anchored to the ground by a stake having at one end a conical plug attached thereto, the plug being matable with the inside of one of the conical projections.

3 Claims, 1 Drawing Sheet

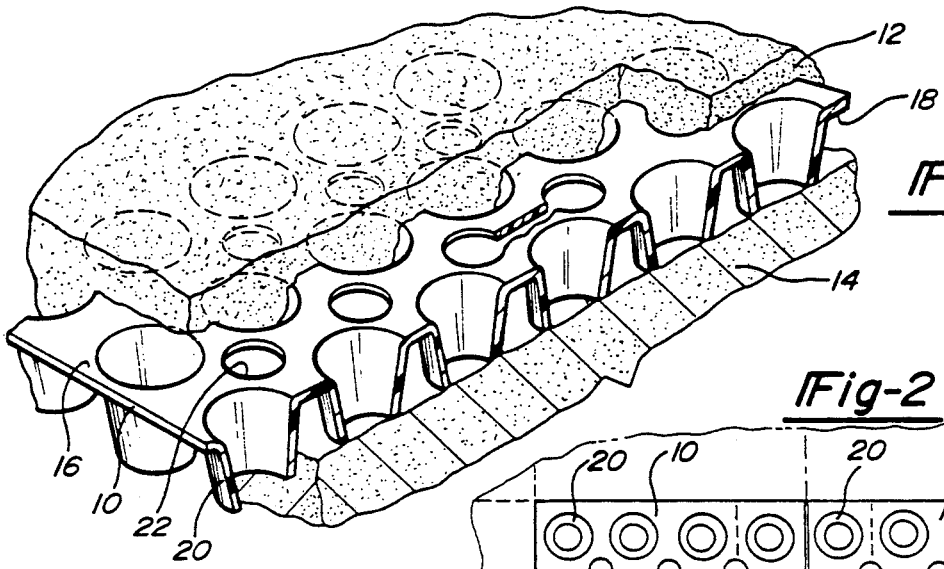
Fig-1
Fig-2
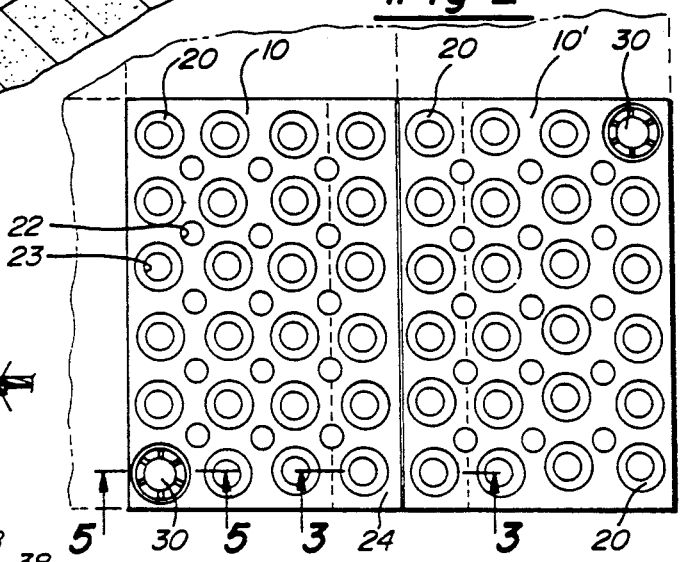
Fig-3
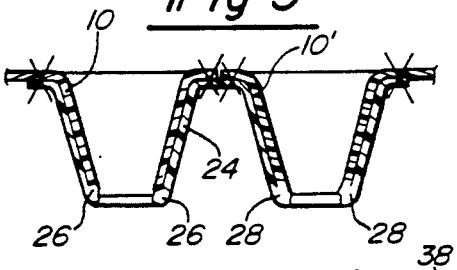
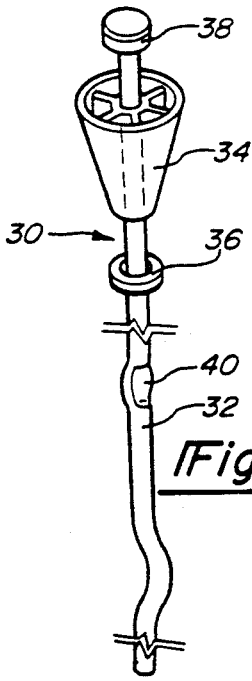
Fig-4
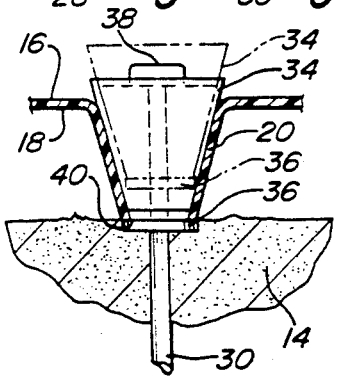
Fig-5
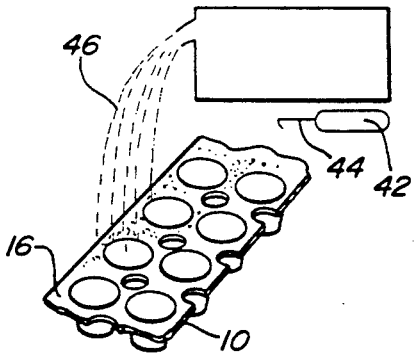
Fig-6

GROUND SUPPORT SYSTEM

BACKGROUND OF THE INVENTION

I. Field of the Invention

The present invention relates generally to a system for providing ground support. More particularly, the present invention provides a ground support system comprised of a number of substantially planar, anchorable members, each member having a number of downward-depending, conically-shaped projections situated thereupon. The present invention has particular utility in providing a ground support system for horses, cows, bulls and the like.

II. Description of the Relevant Art

Throughout history many methods of preparing and providing a solid foundation to function as a roadway or walkway have been developed. When one considers the many contributions of the Romans to civilized society, one often thinks of the great Roman roads or "via" which have survived from Roman times through modern times.

Modern roadways comprise gravel, tar, and, more expensively, cement. While the methods vary, the goal of providing a substantially solid and durable roadway for use by pedestrian and vehicle traffic alike remains the same.

However, while these known systems are quite suitable for pedestrian and vehicle use, such surfaces—whether the surfaces be the stone surface of the Roman road or the paved cement surface of modern roads—are not practical for all purposes. Specifically, such roadways are not practical for use by hooved animals, largely because of the costs involved and, additionally, because such roadways do not readily permit the passage of water or liquid waste. Additionally, such surfaces are generally too hard for the animal to walk upon for long periods or to sleep upon.

Typically, therefore, hooved animals generally are kept in areas that include floors composed of packed dirt. However, in some environments, sand or other loose soil is quite prevalent. In other environments, sand or wood chips are trucked in to provide a surface. The advantage of sand, wood chips or a similar loose surface is not only to allow hooved animals passage thereover with greater comfort, but also to allow water and liquid waste to easily be absorbed into the surface.

However, sand or other loose surface is quickly shuffled away by a hooved animal and the hooved animal quickly leaves tracks, holes, or other indentations so that a once substantially planar surface quickly becomes irregular and difficult to negotiate. Such surfaces while easier to keep clean and sanitary than other surfaces do offer some difficulties in this regard.

There have been apparently no known efforts to provide a surface system for stabilizing sand or a similar loose soil while providing support for hooved animals and the like.

There are known systems of erosion-prevention, and some of these are considered hereafter. The mat system of the present invention is most useful as a ground support for animal stalls and the like but it has other important uses as well. It can be used wherever ground support is desired and it also can be used for erosion control at the same time providing drainage and a means to simplify cleaning and disinfecting.

Generally, erosion control systems may be divided into two marginally overlapping categories, the first being directed at erosion control matting systems, and the second being an erosion-controlling block network.

As to the first category, U.S. Pat. No. 4,135,843 issued to Umemoto et al. discloses a substantially planar mat for application over an eroding surface. Umemoto is directed primarily at providing an erosion control matting. Two other mat systems are directed at having substantially flat mats which are attachable to the protected surface by anchors. These references particularly are directed at permeable mats. The first is U.S. Pat. No. 4,690,585 issued to Holmberg, and the second is U.S. Pat. No. 4,417,828 issued to de Winter. For very solid anchoring, de Winter discloses the use of concrete blocks.

Of the second category which utilizes interconnected blocks to prevent erosion, two references, U.S. Pat. No. 3,597,928 to Pilaar, and U.S. Pat. No. Re. 32,663 issued to Atkinson, disclose this type of system. As to Pilaar, a number of blocks are provided on a flexible liquid-permeable supporting sheet. The other system, that to Atkinson, provides a plurality of interlocking blocks which are structured so that they provide a flexing articulated mat.

In addition to erosion control systems, U.S. Pat. No. 4,854,773 issued to Nicoll discloses a beach carpet for application to the bottom of a body of water for preventing the growth of aquatic plant life.

However, none of the above-cited references is directed to a mat which consists of a plurality of conical projections provided with openings therethrough such as the mat of the present invention. Such a mat is securely anchored in place by the conical projections while at the same time providing the necessary drainage characteristics.

There is known a mat system that provides a stabilized surface over sand which is directed at supporting a person in, for example, a wheelchair on a beach. This system comprises a mat that includes a skeletal layer comprising a grid, which is substantially stiff and inflexible This skeletal layer is disposed between two fabric blankets.

However, this reference, U.S. Pat. No. 4,896,993 issued to Bohnhoff, is limited in its application in that it is for surface application only, is not liquid permeable, and, because it is not directed to utilization on a permanent basis, is only fitted as a temporary construction and lacks a positive anchoring system.

Accordingly, there appear to be no successful ground support systems of the type disclosed by the present invention.

SUMMARY OF THE PRESENT INVENTION

The present invention provides a ground support system for supplying a stabilizing surface in conjunction with loose soil. This system finds particular utility in agricultural applications, such as where horses, cows, bulls and other hooved animals are kept.

The support system comprises a number of connected planar sheets, each planar sheet including a number of spaced apart conical projections disposed on its bottom side. The conical projections are hollow and open ended and, in combination with apertures defined in the planar sheets, permit fluids to pass through the system.

Traction on the upper surface of the member is optionally provided by either scoring the upper surface of the sheet or by adhering ground material thereto. The planar sheets may be anchored to the ground by a stake having at one end a conical plug attached thereto, the plug being matable with the inner side of one of the conical projections provided on the planar sheet. The system according to the present invention provides a support structure for placement in and around places where hooved animals are kept. This system allows for economical and convenient establishment of a surface over which animals may pass. The system can also be used for erosion control and in other areas such as paths, roadways or the like where ground support is desirable.

Because a plurality of apertures are defined in each of the sheets of the system, both water and liquid waste may easily pass through the sheets without compromising the integrity of the system.

The system according to the present invention has a further advantage in that it is composed of a low-cost and lightweight polymerized material, and is therefore easily shipped, stored and installed.

In addition, the present invention offers a relatively simple yet efficient method of anchoring each sheet. The anchoring method is very non-invasive, and yet provides a sure foot hold in the ground.

Other advantages and features of the present invention will become more apparent from the following detailed description when read in conjunction with the accompanying drawing.

BRIEF DESCRIPTION OF THE DRAWINGS

The present invention will be more fully understood by reference to the following detailed description of the preferred embodiments of the present invention when read in conjunction with the accompanying drawings, in which like reference characters refer to like parts throughout the views, and in which:

FIG. 1 is a perspective, partially-sectioned view illustrating the support system of the present invention in place;

FIG. 2 is a top plan view illustrating one preferred method of joining a pair of adjacent sheets;

FIG. 3 is a sectional view taken along line 3—3 of FIG. 2;

FIG. 4 is a peripheral view of the anchoring member according to the present invention;

FIG. 5 is a view taken along line 5—5 of FIG. 2 illustrating the anchoring plug in place in a conical projection of the sheet according to the present invention; and FIG. 6 is a peripheral view illustrating the placement upon a sheet of reground material.

DETAILED DESCRIPTION OF THE PREFERRED EMBODIMENTS OF THE PRESENT INVENTION

The drawing discloses the preferred embodiments of the present invention. While the configurations according to the illustrated embodiments are preferred, it is envisioned that alternate configurations of the present invention may be adopted without deviating from the invention as portrayed. The preferred embodiments are discussed hereafter.

Referring to FIG. 1, a sheet according to the present invention is illustrated as 10. The sheet 10 is disposed between an upper loose soil layer 12 and a lower soil layer 14. The upper layer 12 and the lower layer 14 may be of the same composition, or may be different. For example, the lower layer 14 may be dirt, the sheet 10 placed thereover, and the upper layer 12 may be sand, wood shavings, or a similar material loosely poured thereover.

The sheet 10 is preferably composed of a polymerized material such as plastic or fiberglass, thus reducing cost and weight while increasing resilience, strength and resistance to corrosion.

The sheet 10 has a top side 16 and a bottom side 18. Depending from the bottom side 18 are a plurality of conically-shaped projections 20. As may be seen, the projections 20 are wider at their attachment point with the bottom side 18 than at their far ends. This construction improves the anchoring characteristics of the sheet 10 and simplifies installation.

Because it is important that the sheet 10 permit the passage of water and waste liquid therethrough, a plurality of apertures 22 may be defined in the sheet to provide free flow. In addition, each far end of the projections 20 is preferably open as at 23, to thereby enhance fluid flow. While apertures 22 and openings 23 have both been provided in the illustrated embodiment it should be understood that it may be only necessary to provide one or the other and not both.

Referring to FIG. 2, a top plan view of a pair of sheets 10, 10' in a side-by-side relationship is illustrated to clarify the elements of the system of the present invention as they would appear in place in a barn, field, a track, and the like. According to this view, the relative placement of the projections 20 and the apertures 22 may be seen.

Because the sheets 10, 10' could shift relative to each other unless precautions were taken to the contrary, an interlocking segment 24 may be provided to interlock the sheets 10, 10' together. The interlocking segment 24 comprises a section of a sheet 10 that is fitted over or under an edge row of projections 20, and is similarly fitted to an adjoining sheet.

The interlocking characteristic may be more readily understood by reference to FIG. 3. With reference thereto, the sheet 10 is situated next to the sheet 10' in a side by side relationship. The interlocking segment 24 is in place below the sheets 10, 10', although it may as readily have been situated above the sheets 10, 10'. To join the sheet 10 to the segment 24, heat is applied to fuse the elements together as illustrated at region 26.

Similarly, to join the sheet 10' to the segment 24, heat is applied to fuse the elements together at region 28. Of course, alternate methods of adhesion may be employed, including chemical bonding or mechanical fastening.

Another preferred method of joining the sheets would be to heat weld the adjacent edges together (not shown).

With reference to FIG. 4, an anchor is generally illustrated as 30. The anchor 30 is utilized to firmly yet removably fix the sheets 10, 10' to the lower soil layer 14 (see FIG. 5). The anchor 30 comprises an anchor stem 32, a conical plug 34, and a stop ring 36. Both the plug 34 and the stop ring 36 are slidable along the stem 32 between a stem head 38 and a pinched region 40. The plug 34 is preferably composed of a plastic, and the stem 32 of a metal.

FIG. 5 illustrates the anchor 30 in place and locking a section of the sheet 10 to the lower soil layer 14. Prior to full insertion, as illustrated in broken lines, the plug 34 and the stop ring 36 are both generally positioned within the conical projection 20. The steam head 38 is thereafter pounded or pressed, and the stop ring 36 snaps between a lower edge 40 of the projection 20 and the plug 34. The ring, however, substantially remains above the surface of the lower soil layer 14. The positioning of the anchors 30 is illustrated in FIG. 2.

In some situations it may be desirable to increase the traction on the top surface of the mat. This would be true, for instance, when the mat is used in an animal stall or the like where an animal could expose the surface of the mat and then slip and fall. Because the top side 16 may itself be smooth, different methods of roughening the surface may be employed to increase traction. For example, the surface may have molded thereon coarsening relief, such as dimples or wells.

Alternatively, and with reference to FIG. 6, a tool 42 having a heatable metallic end 44 may be used to repeatedly score the top side 16 of the sheet 10 thereby producing a roughened surface.

As a further alternative, a reground material 46 may be sprinkled over the top side 16, while the mat is heated during the forming process causing the reground material 46 to adhere to the top side 16.

The mat of the present invention can be utilized in a number of different situations. It can be used as a support for animal stalls or the like. When so used it provides support for the dirt or sand used in the stall resisting movement of the dirt or sand and at the same time providing sufficient drainage to maintain sanitary conditions and permitting cleaning and sanitizing. When used as a ground support in high pedestrian traffic areas it will permit grass to be grown through the openings. It similarly can be used for erosion control along beaches and the like. The conical projections provide adequate anchoring so that the mat will be locked in place.

Having described my invention, however, many modifications thereto will become apparent to those skilled in the art to which it pertains without deviation from the spirit of the invention as defined by the scope of the appended claims.

I claim:

1. A ground support system for stabilizing a surface of loose soil, said system comprising:

a substantially planar member, said planar member having a top side and a bottom side;

said planar member including a plurality of spaced apart projections depending therefrom; and said planar member having a plurality of fluid-passing openings permitting the passage of water and waste liquid through said planar member;

means for anchoring said planar member to a layer of soil beneath said planar member; and said anchoring means comprising an anchor stem having an upper end and a lower end; and a locking plug secured to and slidable along said anchor stem, said locking plug being cooperatively fittable within said inside of one of said projections, said locking plug having a top end and a bottom end.

2. The system of claim 1 wherein said locking plug includes tapered sides defining a cone, said top end being wider than said bottom end.

3. The system of claim 1 wherein a locking ring is secured to and slidable along said anchor stem and is fitted next to said bottom end of said locking plug, said locking ring being wider than said bottom end of said locking plug.

* * * * *